United States Patent [19]

Straub

[11] 3,998,030

[45] Dec. 21, 1976

[54] FLEXIBLE WALL PLASTIC BOTTLE FILLING APPARATUS AND METHOD

[76] Inventor: Roy H. Straub, 15604 Pintura Drive, Hacienda Heights, Calif. 91745

[22] Filed: Apr. 21, 1975

[21] Appl. No.: 569,983

[52] U.S. Cl. ..... 53/37; 53/282; 141/390; 198/655

[51] Int. Cl.[2] ..... B65B 3/04

[58] Field of Search ..... 53/37, 282; 141/1, 10, 141/114, 165, 166, 168, 172, 252, 265, 275–278, 313–316, 369, 370, 372, 390; 198/28, 131

[56] References Cited

UNITED STATES PATENTS

| | | | |
|---|---|---|---|
| 2,181,603 | 11/1939 | Long | 141/165 X |
| 2,329,311 | 9/1943 | Waters | 53/37 X |
| 3,630,242 | 12/1971 | Schieser | 141/114 X |
| 3,674,060 | 7/1972 | Ruekberg | 141/114 X |

*Primary Examiner*—Richard E. Aegerter
*Assistant Examiner*—Frederick R. Schmidt
*Attorney, Agent, or Firm*—William W. Haefliger

[57] ABSTRACT

Method and apparatus for imparting dimensional stability to a succession of flexible walled containers during their processing to receive flowable material, the containers characterized by nominal manufacturing tolerances.

20 Claims, 14 Drawing Figures

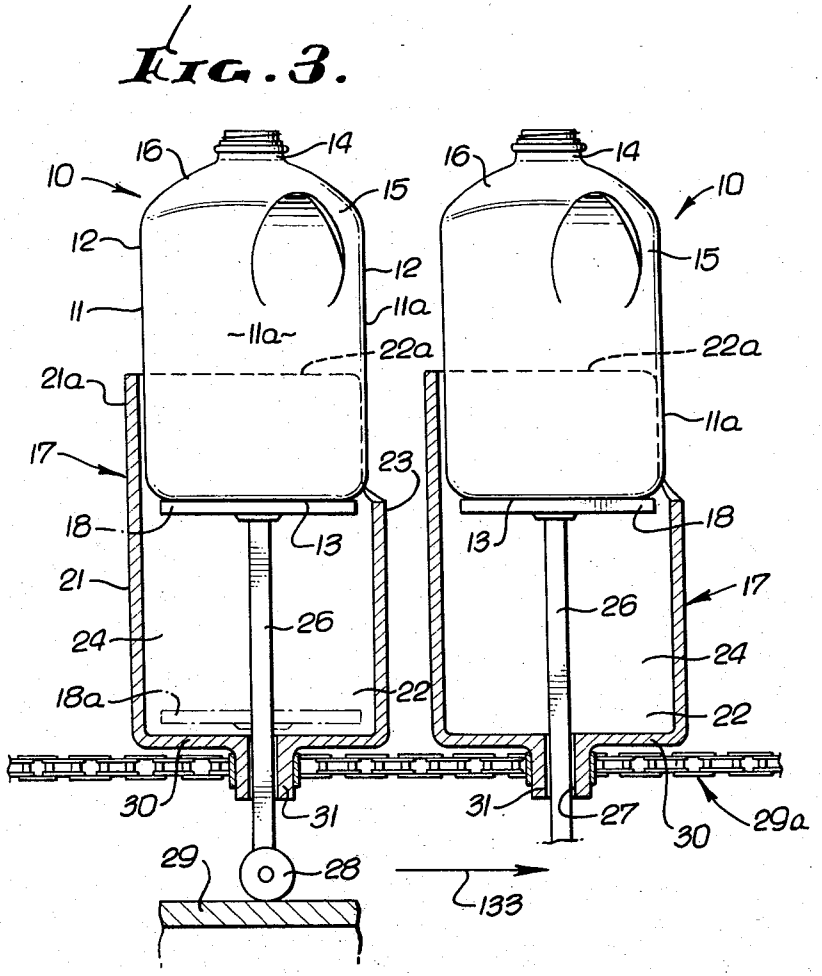
FIG. 3.
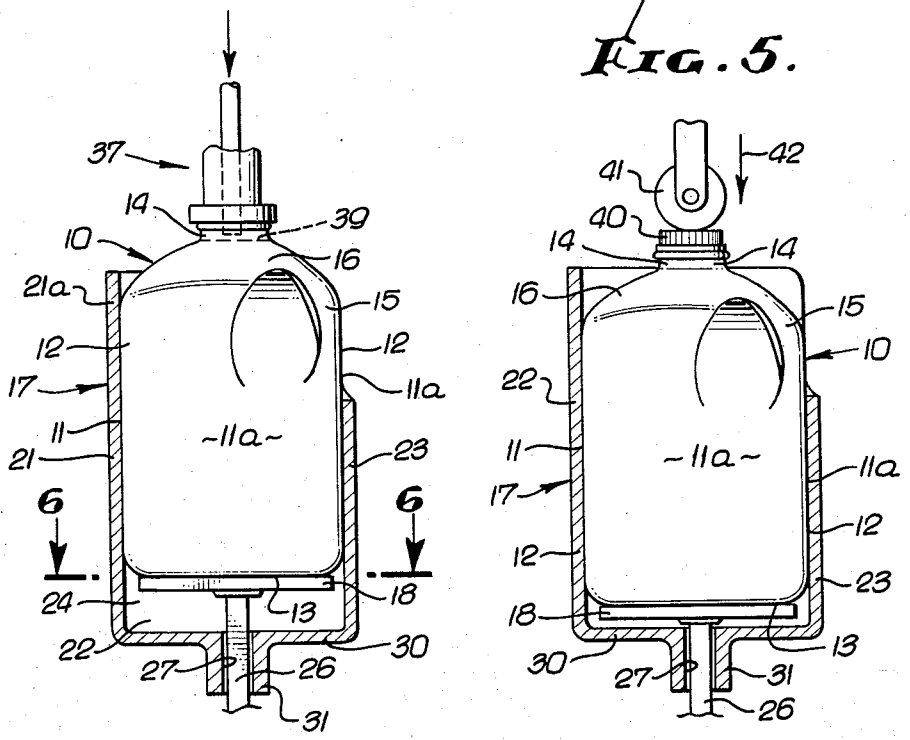
FIG. 4.
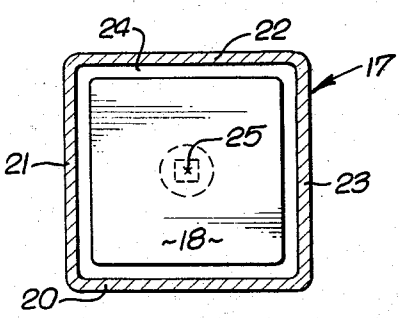
FIG. 6.
FIG. 5.

10
17
18
37
26
28
29
20
33
22a
21a
45
46
40
41
1
2
3
4
5
6
7
8
9
10
11
12
13
14

FLEXIBLE WALL PLASTIC BOTTLE FILLING APPARATUS AND METHOD

BACKGROUND OF THE INVENTION

This invention relates generally to apparatus for rapidly introducing flowable material into flexible walled containers, and more particularly concerns method and apparatus for imparting dimensional stability to a succession of flexible walled containers during processing of same to receive such material, the containers characterized by nominal manufacturing tolerances.

In the very recent past, the need for reducing the plastic content of containers such as bottles has become critical, for reasons such as conservation of petroleum, reduction of cost and minimizing the problem of reclamation of disposal of used or waste bottles; however, it is not easy to reduce such plastic content without suffering problems in bottle filling, transportation and storage. For example, where flexible walled, openly exposed plastic containers are conveyed and flowable material is introduced therein, the pressure generated by that material tends to bow or deflect the walls outwardly, and to an extent which varies with fill rates, density of the material, ambient temperature, etc. As a result, one could not properly speak of "filling" the bottle or container in a determinable sense inasmuch as the resultant top level of the material in the container and relative to the container was unpredictably variable. Further, fill rates of a succession of containers were necessarily limited or restricted to preclude objectionable outward bowing of the sides. In addition, outward bowing of the container walls interfered with side-by-side loading of containers in a shipping carton, as well as unloading of the containers from the carton. While efforts were made to control container side wall deflection, such efforts did not result in the unusual advantages in structure, modes of operation, and results as are now afforded by the present invention.

SUMMARY OF THE INVENTION

It is a major object of the invention to provide novel method and apparatus for handling and rapidly introducing flowable material into plastic containers or bottles whose walls tend to outwardly deflect.

It is another object of the invention to enable satisfactory rapid and complete filling of low cost, lightweight plastic containers obviating problems in handling and transportation of filled containers whose sides have deflected outwardly.

It is a further object of the invention to provide significant savings in plastic material through the use of unusually advantageous apparatus and methods for imparting dimensional stability to plastic containers being filled, and which enable substantial reductions in the quantity of plastic used in blow molding of the containers, and which achieve simplification in the apparatus required to load containers on moving platforms.

Basically, the inventive method includes the steps:

a. successively introducing the containers at a first station respectively into a series of like, rigid, dimensionally sized receptacles, b. traveling the receptacles with the containers therein successively to a second station, c. introducing flowable material into each container at said second station in a manner to cause the sized receptacle to absorb the pressure of the material contents of the container at said station, d. then traveling each container in succession to a third station, e. effecting closing of each containr at said third station, said closing being air tight thereby to allow removal of the sized container from the receptacle in a manner such that the internal pressures previously absorbed by the receptacle are absorbed by the walls of the removed container while the internal volume of the removed container remains the same, whereby tight control on volume and weight of said contents is achieved, f. then traveling each closed container in succession to a fourth station, and g. effecting said removal of the closed container from its receptacle at said fourth station.

As will be seen, the container bottle is typically elevated within a receptacle or box to a position for filling, and then lowered in the receptacle to a position for closing the neck, the container wall or walls remaining confined against outward flexing during such elevation and lowering.

In its apparatus aspects the invention includes:

a. a succession of like, rigid receptacles, and means to travel said receptacles between a series of stations, b. a platform carried for up and down movement in each receptacle, c. said platform having an upper position to receive a container at a first of said stations, d. the platform having a down position in which the container is received in the receptacle, e. the platform having upward and downward motion capability to raise and lower said container for introduction of the flowable contents therein at a second station and for closing of the container at a third station, while the pressure of the contents within the container is absorbed by the receptacle.

Additional objects include the provision of upper local extensions on each receptacle, which serve to limit loading of a container or bottle onto the elevating and lowering platform, sweep the container away from a row of containers advancing toward the receptacle, funnel the recessed container downwardly into the receptacle, and guide removal of a filled container off the raised platform, as will be seen.

These and other objects and advantages of the invention, as well as the details of an illustrative embodiment, will be more fully understood from the following description and drawings, in which:

DRAWING DESCRIPTION

FIG. 3 is an elevation, in section, through apparatus employing the invention, and during bottle loading;

FIG. 4 is a view like FIG. 3 but showing the bottle during filling;

FIG. 5 is a view like FIG. 3 but showing the bottle during capping;

FIG. 6 is a section on lines 6—6 of FIG. 4;

Figures 9A, 9B:
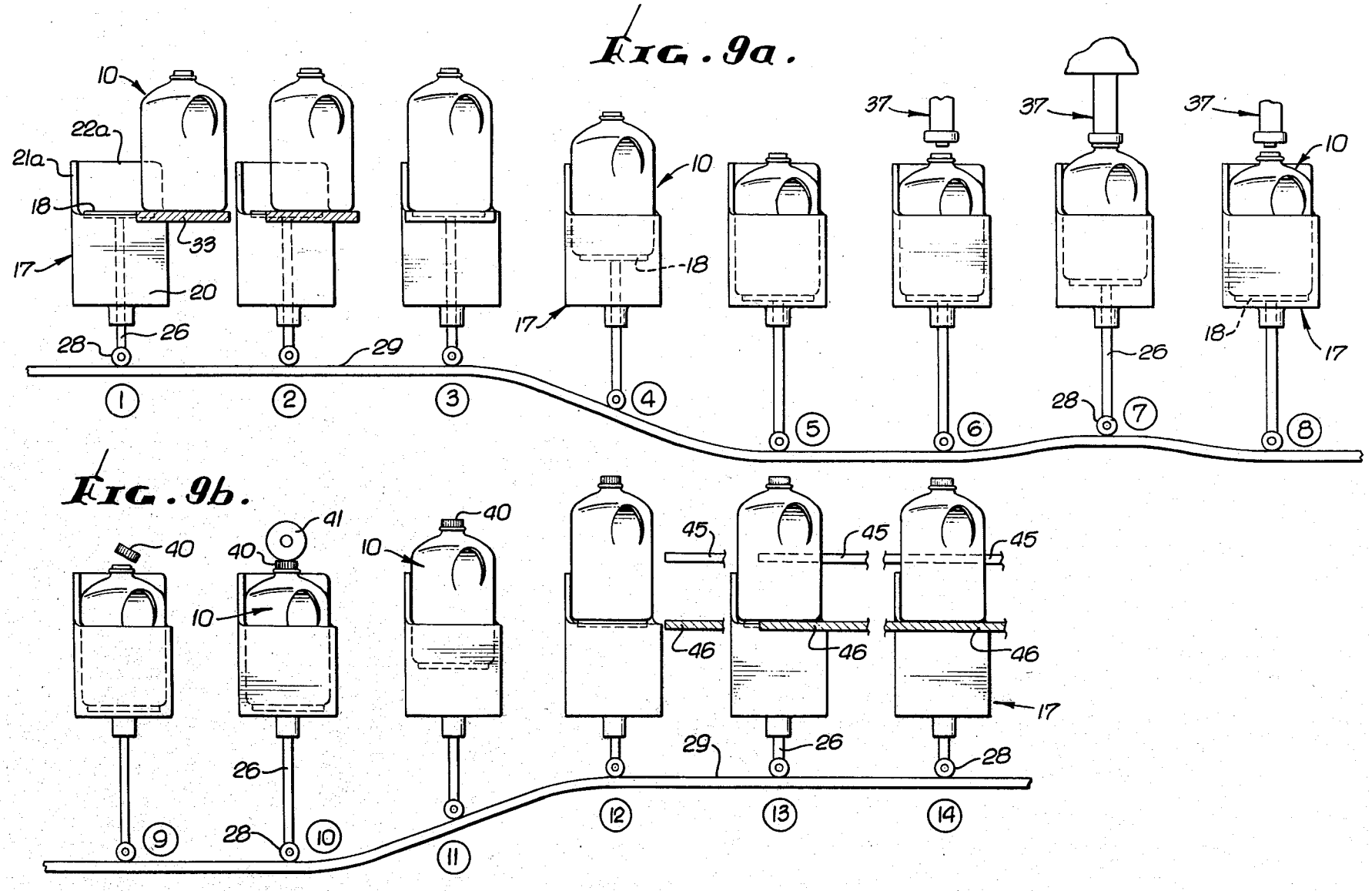
Figure 10:
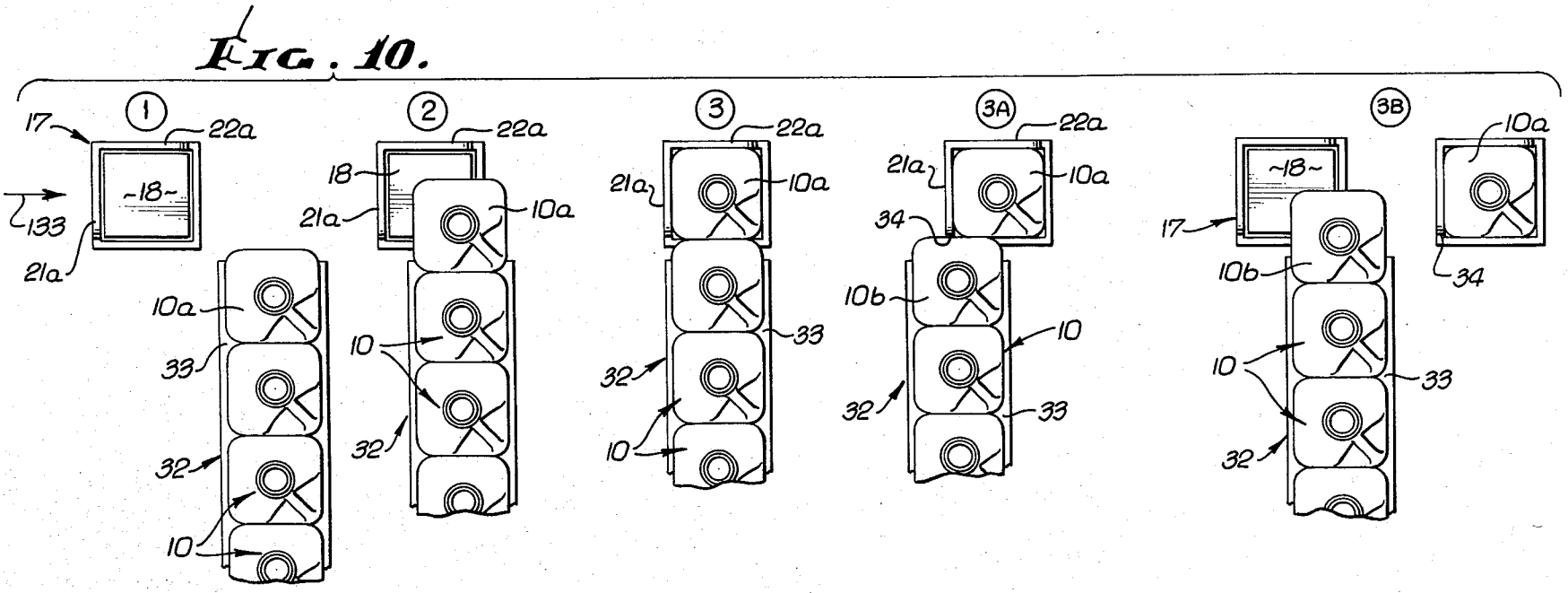
Figure 11:
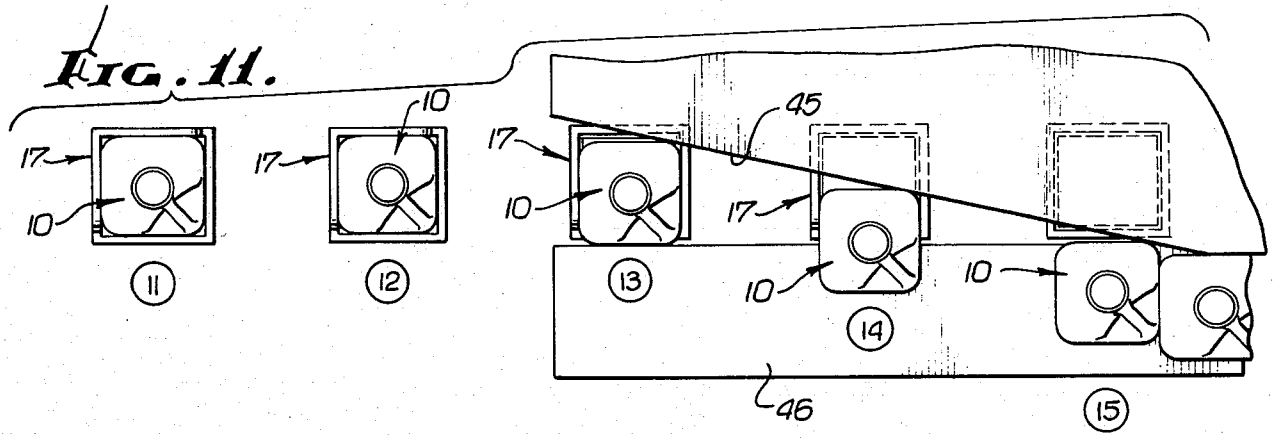

FIGS. 9*a* and 9*b* are elevations (schematic) showing sequential travel of the receptacle between bottle loading and unloading stations;

FIG. 10 is a plan view (schematic) showing sequential stages of bottle loading onto a platform in the receptacle; and FIG. 11 is a plan view (schematic) showing sequential stages of bottle unloading off the platform in the receptacle.

DETAILED DESCRIPTION

Figure 1:
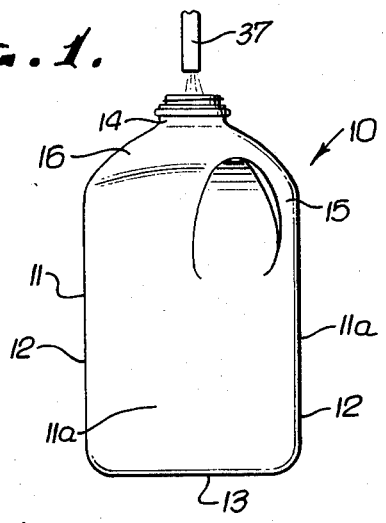
FIG. 1 is elevation showing an unfilled plastic bottle.
Figure 2:
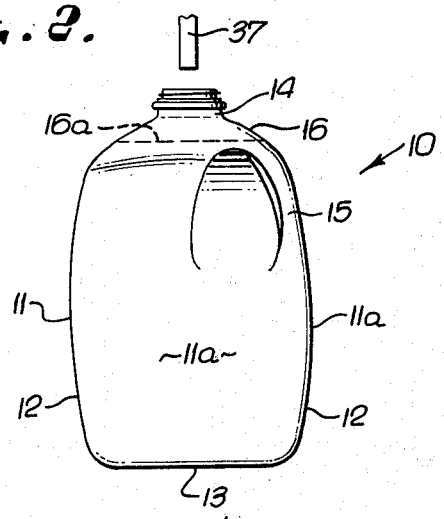
FIG. 2 is an elevation showing the FIG. 1 bottle after conventional filling.
Figure 1A:
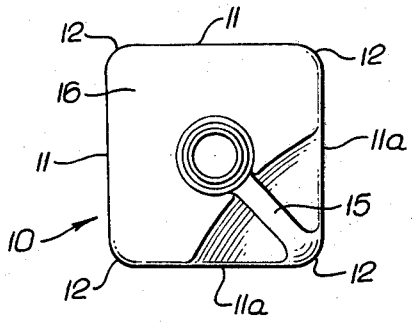
FIG. 1*a* is a top plan view thereof.
Figure 2A:
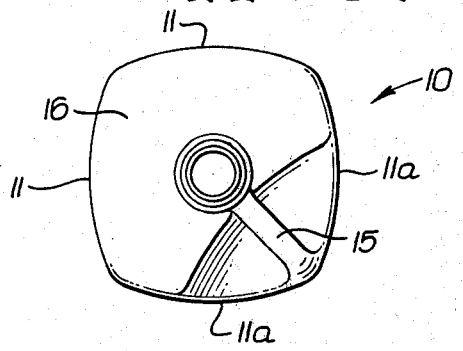
FIG. 2*a* is a top plan view of same.

Referring first to FIGS. 1 and 1*a*, a blow-molded plastic bottle 10 typically has a thin flexible side wall, as may be defined by the four wall portions or flats 11 and 11*a* and arcuate corners 12. The bottle also has a bottom wall 13, neck 14, handle 15 and upper shoulder portion 16, and it may consist of polyethylene or other plastic materials. When liquid such as milk, for example, is filled into the bottle, the walls 11 and 11*a* tend to bulge outwardly as appears in FIGS. 2 and 2*a*, which interferes with loading of multiple bottles into a crate or box; also, a predetermined quantity of liquid is normally filled into the bottle, but if the walls uncontrollably bulge outwardly due to their thinness and reduced strength, the top surface of the liquid drops to an uncontrolled level 16*a* leading to a suspicion of lack of complete filling.

Referring now to FIGS. 3–8, the illustrated apparatus in general includes a receptacle having a primary position relative to a bottle, in which the receptacle maintains the bottle wall confined against outward flexing; while a flowable material such as liquid is filled into the bottle through the neck, and while the filled bottle is closed at the neck to prevent entrance of air into the bottle. The receptacle also has a secondary position relative to the bottle in which the wall of the filled and capped bottle is free to flex. However, since further air cannot enter the capped bottle, the wall does not flex outward after it is freed from confinement.

One example of such a receptacle is that seen at 17, which also has other functions as will appear; in addition, a bottle supporting platform 18 is provided to be vertically movable within the receptacle between multiple positions. As will be seen, platform movement is controlled so that it is fully lowered (as in FIG. 5) relative to the receptacle in the described primary position, it is fully raised relative to the receptacle in the described secondary position (as in FIG. 3), and it may have an intermediate position (as in FIG. 4) in which the bottle wall is also confined by the receptacle against outward flexing.

Figure 8:
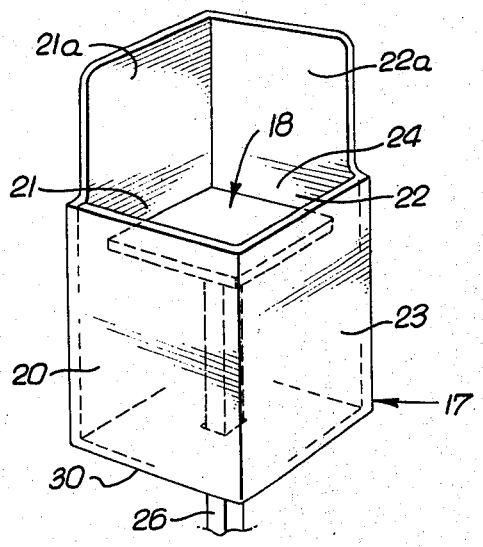
FIG. 8 is a perspective view of a bottle receptacle as appears in FIGS. 3–7.

Extending the description of FIGS. 6 and 8, the illustrated receptacle or box 17 has four upright plates or walls 20, 21, 22 and 23, two of which (20 and 22 for example) are parallel, and also perpendicular to the walls 21 and 23. The spacing of the walls is such that the unfilled bottle is loosely vertically receivable downwardly into the receptacle interior 24, with the flats 11 and 11*a* closely spaced from and adjacent to the respective walls. Typically, the walls may consist of metal such as stainless steel. Further, the receptacle has an upright central axis 25 coinciding with the central axis of square sided platform 18, as appears in FIG. 6.

The receptacle also has upstanding upper flange means as for example may desirably include upper extension 21*a* of plate 21, and upper extension 22*a* of plate 22, such extensions projecting above the upper edge levels of plates 20 and 23. Accordingly, the pair 21 and 22 may be considered as "high" plates, and pair 20 and 23 as "low" plates. Platform 18 is moved up and down in spaced relation to the plates, as by a column or post 26, the latter having a polygonal cross-section (as for example square) to be guided up and down in matching cross-section bore 27. A cam roller 28 carried at the lower end of the column rides on a lengthwise extending cam rail 29 which includes risers to elevate the post, platform and bottle from fully lowered position (indicated by the broken lines 18*a* in FIG. 3), to intermediate position in FIG. 4, and fully elevated position seen in FIG. 5, and to lower the platform to 18*a* position, as will be more fully explained in connection with FIGS. 9*a* and 9*b*. The receptacle 17 is suitably conveyed in the direction of rail 29, as by a conventional articulated section conveyor 29*a*, the latter carrying the receptacles; for example, the bottoms 30 of the receptacles may have downward extensions 31 suitably received in openings formed by the conveyor, the extensions forming the bores 27.

Referring now to FIGS. 3 and 10, a row 32 of empty bottles 10 typically advances generally horizontally along a conveyor or chute 33 toward a receptacle 17 traveling horizontally in direction 133. This appears in positions (1)–(3) of FIG. 10, the same chute being illustrated in each view. The first 10*a* of the bottles in the row is progressively advanced into fully received position (3) in FIG. 10, wherein it is centered on platform 18, and preferably closely spaced to wall upper extensions 21*a* and 22*a*. The latter, extending in a forward direction, may serve as a stop to limit sideward advancement of the first bottle, and of the row of bottles. As the receptacle 17 proceeds to advance as seen in (3A) position, the plate upper extension 21*a* may serve to forwardly impel or travel the bottle 10*a*, and its vertical lateral edge 34 wipes against or sweeps past the side of the next bottle 10*b* in the row, blocking advancement of the row until edge 34 clears that bottle. In position (3B) of FIG. 10, the edge 34 has traveled past the next bottle 10*b*, which in its turn is advancing onto the platform 18 in the next-in-line receptacle 17. FIG. 3 shows two such bottles which have been advanced (in a direction into the plane of the sheet) and onto the platforms 18. Note that reception of the bottles on the platforms is such that higher side flats 11 closely face the higher walls 21 and 22, whereas lower side flats 11*a* closely face the lower walls 20 and 23, in both lowered and intermediate positions of the bottle in the receptacle, i.e. the positions of FIGS. 5 and 4, respectively. It should be noted that the described apparatus enables elimination of the commonly employed star wheel which rotates to transfer bottles from a conveyor to bottle platforms which remain at fixed level.

In the intermediate position of FIG. 4, the bottle is partly raised by the platform for filling as by means of a suitable filler valve 37, such valves being well known in the art. A quantity of flowable material, as for example milk, is introduced via the filler valve into the bottle via its neck (with which the valve nozzle has telescopic interfit), the ultimate upper level of the liquid indicated for example at 39. During such filling, the bottle side walls (or flats) 11 and 11*a* are confined against outward expansion by receptacle walls or panels 20–23, so that level 39 does not undesirably drop; also, the receptacle walls absorb the pressure of material contents of the container. At a subsequent station, the platform is lowered to FIG. 5 position, at which time the bottle is capped. A plastic seal cap 40 is there shown as pressed down over the typically beaded upper rim of the neck 14, a downward pressing roller 41 being used in the illustrated example. Despite exertion of substantial downward force indicated at 42 (which may resiliently deflect the bottle upper shoulder 16 downwardly) the bottle walls cannot be outwardly expanded, as they are confined or sized by the receptacle, as described.

In FIG. 4, the filler valve 37 may itself be displaced downwardly to interfit the bottle neck, the bottle being at the position shown, or at a lower position in the receptacle.

Figure 7:
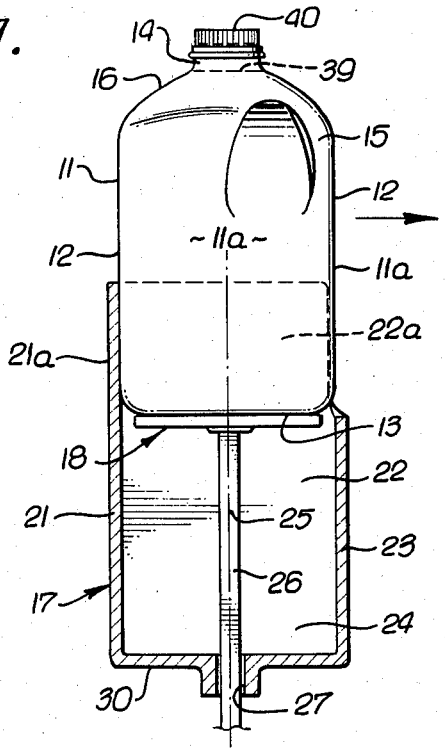
FIG. 7 is a view like FIG. 3 but showing the filled bottle elevated for unloading.

FIGS. 9*a* and 9*b* show in a sequence of positions (1)–(14) the travel of a typical receptacle and bottle from first station loading positions (1)–(3) corresponding to such positions also described in FIG. 10, to second station filling position (7), to third station capping positions (9) and (10), and finally bottle removal or discharge positions (12)–(14) at a fourth station. FIG. 7 also shows the filled and capped bottle completely elevated and positioned for removal off the platform in a direction out of plane of the paper and toward the viewer. FIG. 11 also shows positions (11) etc. corresponding to similarly numbered positions in FIG. 9*b*. A deflector 45 is employed to engage the approaching bottle and urge it off the platform 18 onto a subsequent chute or conveyor 46, the receptacles 17 passing beneath the deflector.

It is clear from FIGS. 3, 9*a*, 9*b*, 10, 11 and the above description that the platform 18 has an upper position adjacent the upper rims of receptacle plates 20 and 23 to sidewardly receive the container at a first station (1)–(3); also the platform is raised into adjacency to those upper rims at a fourth station (12)–(14) for removal of the container off the platofrm and sidewardly over at least one such rim. Also, it is clear from FIGS. 3–6 that the container is bounded or surrounded on all sides by the receptacle as the container is moved vertically in the receptacle.

I claim:

1. Method of giving dimensional stability to a succession of flexible walled containers during processing of the containers to receive flowable material, the containers characterized by nominal manufacturing tolerances, said method including:

a. successively sidewardly introducing the containers at a first station respectively into vertical alignment with a series of like, rigid, dimensionally sized receptacles, and lowering the containers therein while maintaining the containers surrounded on all sides of the receptacles, b. traveling the receptacles with the containers therein successively to a second station, c. introducing flowable material into each container at said second station in a manner to cause the sized receptacle to sidewardly absorb the pressure of the material contents of the surrounded container at said station, the containers being moved vertically in and relative to the bounding receptacles both prior to and subsequent to said introduction of the flowable material, d. traveling each container in succession to a third station, e. effecting closing of each container at said third station, said closing being air tight thereby to allow removal of the sized container from the receptacle in a manner such that the internal pressures previously sidewardly absorbed by the receptacle are absorbed by the walls of the removed container while the internal volume of the removed container remains the same, whereby tight control on volume and weight of said contents is achieved, f. traveling each closed container in succession to a fourth station, and g. effecting said removal of the closed container from its receptacle at said fourth station.

2. The method of claim 1 wherein said introducing of the containers into said receptacles at said first station is carried out by sidewardly advancing a row of the containers toward said receptacles to advance forwardmost containers in the row over upper rims of the receptacles.

3. The method of claim 2 including the step of relatively elevating the container in the receptacle to receive said introduction of flowable material into the container.

4. The method of claim 3 including the step of relatively lowering the container in the receptacle immediately following said introduction of flowable material into the container.

5. The method of claim 4 wherein said closing of the container at said third station is carried out while the container remains relatively lowered in the receptacle.

6. The method of claim 5 wherein said closing is carried out to transmit closing pressure to said contents and container which in turn transmit said pressures to said receptacle.

7. The method of claim 6 including the step of relatively elevating the closed container in the receptacle to permit said removal of the container from the receptacle sidewardly over said rim at said fourth station.

8. The method of claim 7 wherein said elevating and lowering of the container is effected by elevating and lowering a bottom support for the container.

9. The method of claim 3 wherein the container has side wall flats, and wherein said flats are maintained in position to transmit said pressure of said contents to said receptacle when the container is elevated.

10. Apparatus for giving dimensional stability to a succession of flexible walled containers during processing thereof to receive flowable contents, comprising a. a succession of like, rigid receptacles, and means to travel said receptacles between a series of stations, b. a platform carried for up and down movement in and relative to each receptacle, c. said platform having an upper position adjacent an upper rim of the receptacle to sidewardly receive a container at a first of said stations, d. the platform having a down position relative to the receptacle and in which the container is received downwardly in the receptacle, e. means for moving the platform vertically between said positions and relative to the receptacle to raise and lower said container, means for introducing said flowable contents into the container at a second station and means for closing the container at a third station while the pressure of the contents within the container is absorbed by the receptacle, the platform being elevated into adjacency to said upper rim of the receptacle at a fourth station and means for removing the container off the platform and sidewardly over said rim.

11. Apparatus of claim 10 wherein said platform has a raised position in which the container is removed off the platform and away from the receptacle at said fourth station.

12. Apparatus of claim 10 wherein the receptacle is interiorly configured in correspondence to the container side configuration to bound the container on all sides in said down position.

13. Apparatus of claim 12 wherein the receptacle has four walls, the first and third of which are parallel and upright, and the second and fourth of which are also parallel and upright but normal to the first and third walls.

14. Apparatus of claim 13 including the container which has four side wall flats which respectively face said receptacle walls and are closely spaced thereto in lowered position of the platform and prior to said introduction of said contents.

15. The apparatus of claim 13 wherein said first and fourth walls have upper extensions projecting above the levels of the tops of the second and third walls.

16. The apparatus of claim 15 wherein said upper extensions of the first and fourth walls respectively extend in said direction of travel and perpendicular thereto.

17. The apparatus of claim 16 including conveyor means at the first station directed to supply a container onto said raised platform toward said first wall upper extension.

18. The apparatus of claim 17 wherein the fourth wall upper extension is located to sweep the container loaded on the platform away from a row of containers being fed toward the receptacle on the conveyor.

19. The apparatus of claim 18 wherein said two upper extensions are positioned to cooperate in funneling of the loaded container toward the interior of the receptacle during lowering of the platform.

20. The apparatus of claim 18 wherein at said fourth station said fourth wall upper extension is located to urge the elevated container toward a cam surface acting to laterally displace the container off the platform as a result of forward travel of the receptacles under the cam surface, said cam surface defined by said means for removing the container off the platform.

* * * * *